US011440155B2

(12) United States Patent
Fogelberg

(10) Patent No.: US 11,440,155 B2
(45) Date of Patent: Sep. 13, 2022

(54) FLOOR GRINDING MACHINE, METHOD OF OPERATING FLOOR GRINDING MACHINE

(71) Applicant: HUSQVARNA AB, Huskvarna (SE)

(72) Inventor: Andreas Fogelberg, Söderköping (SE)

(73) Assignee: HUSQVARNA AB, Huskvarna (SE)

( * ) Notice: Subject to any disclaimer, the term of this patent is extended or adjusted under 35 U.S.C. 154(b) by 817 days.

(21) Appl. No.: 16/305,976

(22) PCT Filed: Jun. 1, 2017

(86) PCT No.: PCT/EP2017/063375
§ 371 (c)(1),
(2) Date: Nov. 30, 2018

(87) PCT Pub. No.: WO2017/207723
PCT Pub. Date: Dec. 7, 2017

(65) Prior Publication Data

US 2019/0270173 A1 Sep. 5, 2019

(30) Foreign Application Priority Data

Jun. 3, 2016 (SE) ..... 1650788-1

(51) Int. Cl.
*B24B 7/18* (2006.01)
*B24B 41/047* (2006.01)
(Continued)

(52) U.S. Cl.
CPC ..... *B24B 7/186* (2013.01); *B24B 7/18* (2013.01); *B24B 7/224* (2013.01); *B24B 23/02* (2013.01);
(Continued)

(58) Field of Classification Search
CPC ..... B24B 7/18; B24B 7/186; B24B 7/188; B24B 7/22; B24B 7/224; B24B 23/00;
(Continued)

(56) References Cited

U.S. PATENT DOCUMENTS 1,974,136 A 9/1934 Emmons
5,605,493 A 2/1997 Donatelli et al.
(Continued)

FOREIGN PATENT DOCUMENTS

CN 202313127 U 7/2012
CN 202357004 U 8/2012
(Continued)

OTHER PUBLICATIONS

International Search Report for International Application No. PCT/EP2017/063375, dated Aug. 9, 2017 (3 pages).
(Continued)

*Primary Examiner* — Eileen P Morgan
(74) *Attorney, Agent, or Firm* — Burr & Forman LLP

(57) ABSTRACT

The present disclosure relates to a floor grinding machine for grinding floor surfaces of stone or stone-like material. Such a machine comprises a machine frame, a grinding head 2, supported by and being rotatable relative to the machine frame, a grinding head hood 2, which defines a space in which the grinding head 1 is rotatable, a hollow and resilient member 4, arranged in the space, and a pressurized fluid source, operatively connected to the hollow member 4 to supply said pressurized fluid, whereby the hollow member 4 is resiliently expandable upon supply of said fluid.

20 Claims, 2 Drawing Sheets

(51) Int. Cl.

| | |
|---|---|
| ***B24B 23/02*** | (2006.01) |
| ***B24B 55/02*** | (2006.01) |
| ***B24B 55/05*** | (2006.01) |
| ***B24B 55/10*** | (2006.01) |
| ***B24B 55/12*** | (2006.01) |
| ***B24B 55/04*** | (2006.01) |
| ***B24B 7/22*** | (2006.01) |
| *B24B 55/06* | (2006.01) |

(52) U.S. Cl.
CPC ..... *B24B 41/047* (2013.01); *B24B 55/02* (2013.01); *B24B 55/045* (2013.01); *B24B 55/052* (2013.01); *B24B 55/102* (2013.01); *B24B 55/12* (2013.01); *B24B 55/04* (2013.01); *B24B 55/06* (2013.01)

(58) Field of Classification Search
CPC . B24B 23/02; B24B 27/0007; B24B 27/0076; B24B 41/047; B24B 55/02; B24B 55/04; B24B 55/045; B24B 55/05; B24B 55/052; B24B 55/055; B24B 55/102; B24B 55/12
USPC ..... 451/344, 350–353, 449, 450, 455
See application file for complete search history.

(56) References Cited

U.S. PATENT DOCUMENTS

| | | | | |
|---|---|---|---|---|
| 6,238,277 | B1 * | 5/2001 | Duncan | A47L 11/16 451/271 |
| 10,702,054 | B2 * | 7/2020 | Rudolph | A47L 11/161 |
| 10,933,506 | B2 * | 3/2021 | Kerestes | B24B 7/18 |
| 2006/0026781 | A1 | 2/2006 | Van Vliet | |
| 2008/0078041 | A1 * | 4/2008 | Mitchel | A47L 11/4069 15/50.3 |
| 2008/0201877 | A1 * | 8/2008 | Sengewald | A47L 11/4075 15/4 |
| 2011/0099748 | A1 | 5/2011 | Barous | |
| 2012/0279010 | A1 * | 11/2012 | Kenter | A47L 11/305 15/320 |
| 2013/0084782 | A1 | 4/2013 | McCutchen et al. | |
| 2014/0273776 | A1 | 9/2014 | Leighton et al. | |
| 2016/0031061 | A1 * | 2/2016 | Truong | B24B 7/186 451/353 |
| 2017/0245721 | A1 * | 8/2017 | Rudolph | B24B 29/005 |
| 2018/0369981 | A1 * | 12/2018 | Craft | B24B 47/12 |
| 2019/0343363 | A1 * | 11/2019 | Stuchlik | A47L 11/305 |

FOREIGN PATENT DOCUMENTS

| | | | |
|---|---|---|---|
| CN | 202908627 | U | 5/2013 |
| CN | 105150041 | A1 | 12/2015 |
| CN | 205207361 | U | 5/2016 |
| DE | 20201500403 | U1 | 3/2015 |
| EP | 1806206 | A1 | 7/2007 |
| EP | 1942238 | A1 | 7/2008 |
| EP | 2329914 | A2 | 6/2011 |
| EP | 2329915 | A2 | 6/2011 |
| EP | 2381430 | A1 | 10/2011 |
| EP | 2561959 | A1 | 2/2013 |
| GB | 321860 | A | 11/1929 |
| GB | 2232367 | A | 12/1990 |
| KR | 20110004186 | U | 4/2011 |
| NL | 1014015 | C2 | 7/2001 |
| WO | 0001291 | A1 | 1/2000 |
| WO | 03076131 | A1 | 9/2003 |
| WO | 2007021191 | A2 | 2/2007 |
| WO | 20130106917 | A1 | 7/2013 |
| WO | 2015167376 | A1 | 11/2015 |

OTHER PUBLICATIONS

E-Spac abstract of CN 202908627.
E-Spae abstract of DE 202015100403.
International Search Repot for Swedish Aplication No. 1650788-1, dated Dec. 30, 2016 (2 pages).
International Search Report for International Application No. PCT/EP2017/063374, dated Nov. 23, 2017 (5 pages).
International Search Report for Swedish Application No. 1650787-3, dated Jan. 30, 2017 (2 pages).
International Search Report for International Application No. PCT/EP2017/063373, dated Mar. 5, 2018 (6 pages).
E-Space abstract of NL 1014015.
E-Space abstract of CN 105160041.
E-Space abstract of CN 202357004.

* cited by examiner

FLOOR GRINDING MACHINE, METHOD OF OPERATING FLOOR GRINDING MACHINE

CROSS-REFERENCE TO RELATED APPLICATIONS

This application claims priority to International Application No. PCT/EP2017/063375, filed Jun. 1, 2017 and titled "FLOOR GRINDING MACHINE, METHOD OF OPERATING FLOORGRINDING MACHINE," which in turn claims priority from a Swedish Application having serial number 1650188-1, filed Jun. 3, 2016 and titled "FLOOR GRINDING MACHINE, METHOD OF OPERATING FLOORGRINDING MACHINE," both of which are incorporated herein by reference in their entireties.

TECHNICAL FIELD

The present disclosure relates to floor grinding machines, and in particular to floor grinding machines adapted for grinding floors of stone or stone-like materials, such as limestone, sandstone, marble, slate, granite, concrete or terrazzo.

BACKGROUND

Floor grinding machines are known and used in polishing or grinding floor surfaces, either with the purpose of producing a level and/or glossy floor surface, or with the purpose of renovating such a surface which has deteriorated due to e.g. wear, or which has been damaged.

A floor grinding machine for this type of grinding typically comprises a machine frame, which carries a motor that is operatively connected to a grinding head.

In a particular class of floor grinding machines, such a grinding head may be rotatable relative to the machine frame. The grinding head may carry a plurality of grinding disks, each of which may be rotatable relative to the grinding head. Such a grinding head is typically referred to as a planetary type grinding head.

These floor grinding machines are usually equipped with grinding elements in the form of bonded abrasives, i.e. abrasives in the form of a three-dimensional body comprising abrasive particles and a matrix material, which may be a polymer material or a metallic material. As another option, the machines may be equipped with cutting elements, adapted, for example for removal of glue, paint, lacquer or other surface treatments from a floor surface.

The machine may typically be supported by its grinding head and often also by a pair of wheels, which may be arranged behind the grinding head, as seen in a forward direction of the machine. Optionally, the machine may also be supported by one or more further wheels, which may be used to control the pressure exerted by the grinding head on the floor.

The pair of wheels may be driven. Optionally, they may be individually drivable, such that a direction of travel of the machine may be controlled. The floor grinding machine may comprise a water feeding device. The floor grinding machine may also comprise a water spay device for wetting the surface to be grinded or polished and/or for cooling down the grinding head.

One example of a known machine of this type is disclosed in WO03076131A1.

Grinding floors of stone or stone-like materials, such as limestone, sandstone, marble, slate, granite, concrete or terrazzo, generates grinding residues, such as dust, particles and small portions of the floor material. Some residues, especially those in the form of very small particles, and especially when grinding using water, may attach to the grinding machine, especially on an inside of a grinding head hood, which encloses the grinding head. In particular, the residues may build up to form essentially a block of concrete or cement. The presence of such residues may also negatively influence the heat dissipation, the rotation of the grinding disks, and may thus degrade the grinding efficiency of the machine. In addition, it may add to the weight of the machine, and thus affect its balancing.

Cleaning the machine will thus be essential. However, such cleaning may be difficult in cases where large chunks of residues have formed. There is a risk that the cleaning process, which may involve use of a hammer and chisel, may damage the machine.

Thus, there is a need for a floor grinding machine which is easier to clean.

Therefore, there remains a need for an improved floor grinding machine, which can at least partly alleviate at least some of the above-mentioned drawbacks.

SUMMARY

An object of the present disclosure is to provide an improved floor grinding machine for grinding floor surfaces of stone or stone-like materials.

A particular object is to provide a floor grinding machine which is easier to clean.

The invention is defined by the appended independent claims, with embodiments being set forth in the appended dependent claims in the following description and in the attached drawings.

According to a first aspect, there is provided a floor grinding machine for grinding floor surfaces of stone or stone-like material, the machine comprising: a machine frame, a grinding head, supported by and being rotatable relative to the machine frame, a grinding head hood, which defines a space in which the grinding head is rotatable, a resilient member, and a pressurized fluid source, operatively connected to the resilient member to supply said pressurized fluid, whereby the resilient member, or a portion thereof, is resiliently movable or expandable upon supply of said fluid.

The accumulated grinding residues can firmly attach to the inside of the hood over time, which are difficult to clean. Thus, a frequent cleaning is needed to remove these residues. However, it is difficult to remove those residues between the grinding head casing and the hood without separating the hood and the casing by e.g. disassembling.

By expanding the hollow member inside the hood, the grinding residues accumulated, being attached to and/or being closed to the hollow member, can be easily removed. Thus, such a floor grinding machine is easy to clean. And less effort is needed for frequent cleanings.

The stone or stone-like material may have a Knoop hardness of more than 130, preferably more than 135 or 140. The material may thus comprise such as limestone, sandstone, marble, slate, granite, concrete or terrazzo.

The fluid may be a liquid, such as water, or a gas, such as air. For example, water is normally used for wetting the surfaces and/or for cooling down the grinding head and/or the grinding machine. As another option, the fluid may be an aerosol.

As one option, the resilient member may be arranged inside the space.

As another option, the resilient member may be arranged outside the space.

The resilient member may be hollow, the pressurized fluid source may be operatively connected to supply the pressurized fluid to an interior of the resilient member and the resilient member may be resiliently expandable upon supply of said fluid.

The hollow member may comprise a tubular body.

The tubular body can be arranged inside the hood by taking a limited space. Thus, the floor grinding machine with the hollow member can still be built compact.

The hollow member may be arranged on, or forms part of a wall of the hood.

For example, the resilient member may form part of an inwardly, towards the space, facing wall of the hood.

The hollow member, or part of it, may e.g. form an inwardly facing lining of the hood. As another option, the hood, or part of it, may be made of a resilient material, and thus the hood may form at least part of the hollow member.

The hollow member may be arranged along an inner surface of the hood. It is beneficial since the grinding residues accumulated along the inner surface of the hood can be effectively removed by expansion of the hollow member.

The hollow member may extend at least 40%, preferably at least 50%, at least 60%, at least 70% or at least 80%, of an inner circumference of the hood.

The hollow member may be expandable so as to provide a dimensional change, in at least one direction, of at least 1%, preferably at least 2%, at least 5% or at least 10%, upon supply of said fluid.

The dimensional change of the hollow member can provide a force which is easy to remove grinding residues, such as a block of concrete or cement, being attached to and/or being closed to the hollow member.

The hollow member may be arranged at a transition portion between an upper horizontal portion of the hood and a downwardly extending edge portion of the hood.

The transition portion between the upper horizontal portion and the downwardly extending edge portion of the hood can be difficult to reach without disassembling the grinding head case from the hood. Thus, it is difficult to timely remove the grinding residues accumulated at the transition portion. However, the hollow member being arranged at a transition portion can remove the residues of the transition portion without disassembling the machine, which is convenient.

The hollow member may comprise at least one aperture for allowing the fluid to escape.

Such aperture may be sized and adapted to provide a restriction of the flow, such that part of the pressure inside the hollow member may be retained while some fluid is allowed to escape.

Besides the expansion of the hollow member, the fluid from the aperture can also be used to clean the inside of the hood and the outside of the casing. Additionally, the fluid can also be used to wetting the surface being grinded and/or polished, and/or to decrease the temperature of the grinding head.

The aperture may be substantially closed when the hollow member is at a normal ambient pressure, and opened when pressurized by supply of said fluid from inside of the hollow member.

"Substantially closed" means that the fluid escaped from the aperture is at most 10%, preferably at most 5%, at most 3%, or at most 1% of the fluid flew through a portion of the hollow member comprising the aperture.

"A normal ambient pressure" means an atmospheric pressure, e.g. a normal atmosphere.

A plurality of apertures may be arranged on the hollow member along a circumferential direction of the hood.

By arranging the apertures along the circumferential direction of the hood, the fluid escaping from the plurality of apertures can rinse different portions of the inside of the hood. Thus, more residues can be removed and a better cleaning effect can be achieved.

The aperture may be a slit. For example, the aperture may be formed as a through-going cut in a wall forming the hollow member, such that the aperture is normally closed and opens only on pressurization of the hollow member. Such a slit is easy and low-cost to manufacture.

The slit may extend along a longitudinal direction of the hollow member.

Alternatively, the slit may extend along a direction which is non-parallel with the longitudinal direction of the hollow member.

For example, the slit may extend transversely of the longitudinal direction of the hollow member, or at any angle, such as at 0°-90° to the longitudinal direction.

The floor grinding machine may further comprise a nozzle operatively connected to the hollow member to receive said fluid and to spray the same.

The nozzle and the hollow member can share the same fluid source, which simplify the construction of the floor grinding machine. Additionally, if only one water tank onboard is needed, the weight of the machine can be reduced.

The nozzle may be arranged outside of the grinding head hood such that the nozzle may spray in a direction toward the floor surface.

The resilient member may comprise a closure which is biased towards a position where it closes an aperture, and wherein the resilient member may be movable to allow fluid to flow through the aperture on supply of said pressurized fluid.

The floor grinding machine may further comprise a hollow member, an interior of which may be connected to the pressurized fluid supply and whereby the aperture is arranged in a wall of the hollow member.

According to a second aspect, there is provided a method of operating a floor grinding machine for grinding floor surfaces of stone or stone-like material, comprising providing a resilient member on a grinding head of the floor grinding machine, and applying a pressurized fluid to the resilient member such that the resilient member moves or deforms, thereby releasing grinding residues accumulated on or in a vicinity of the resilient member.

By providing a resilient member the grinding residues accumulated inside or on the hood can be easily cleaned without disassembling the hood. Further, the residues can be frequently cleaned such that the negative influences caused by the residues can be alleviated.

The resilient member may be a hollow expandable member, and applying the pressurized fluid may comprise causing the resilient member to expand.

The method may further comprise feeding the fluid through at least one aperture of the resilient member, such that the fluid is allowed to exit from the resilient member.

The resilient member may comprise a closure of a hollow member, and the pressurized fluid may be applied to an interior of the hollow member, such that the closure is moved away from an aperture of the hollow member, whereby the fluid is allowed to exit from the hollow member.

The resilient member may be arranged inside a hood enclosing the grinding head.

DETAILED DESCRIPTION

Figure 1:
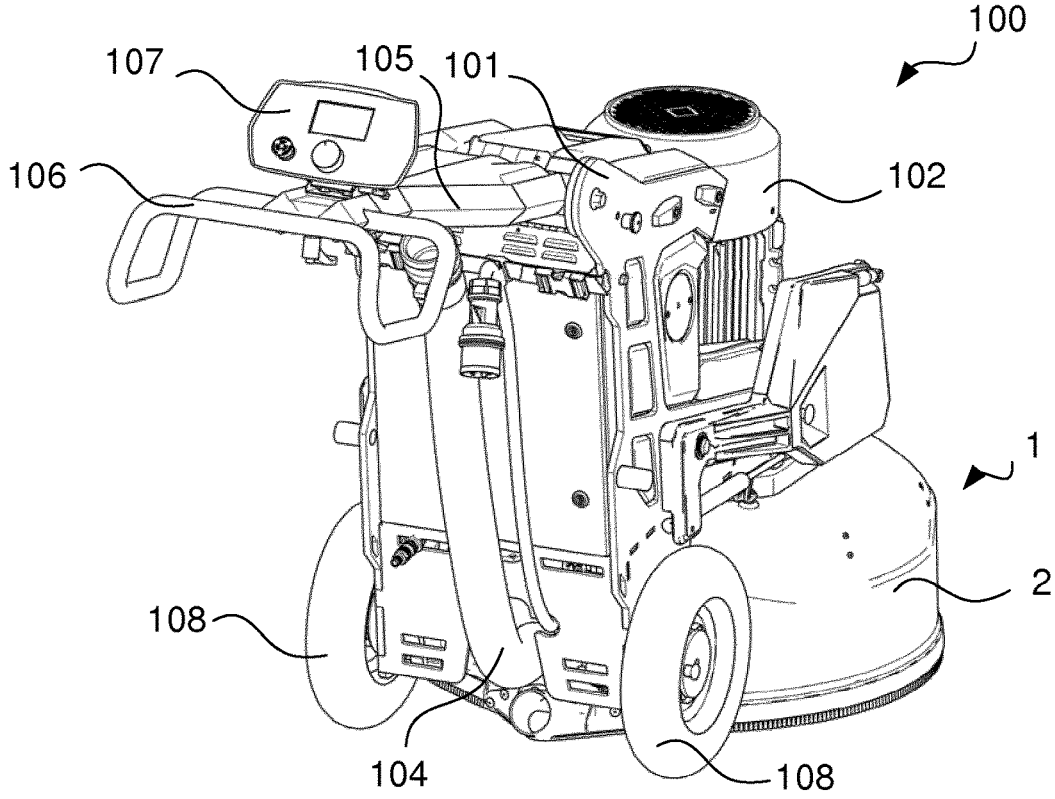
FIG. 1 is a schematic perspective view from behind of a floor grinding machine, in which the concepts according to the present disclosure may be applied.

FIG. 1 schematically illustrates a floor grinding machine 100. The grinding machine 100 comprises a machine frame 101 which supports a grinding head 1 and a motor 102. The grinding head 1 is driven by the motor 102 to rotate.

The grinding head 1 may comprise a grinding head hood 2, which may be arranged to enclose the grinding head casing 5. The grinding head casing 5 may be rotatable inside the hood 2.

The hood 2 may contain grinding residues which can be readily collected by e.g. a collection device as will be further described.

The machine 100 may thus further comprise a collection device for collecting grinding residues, such as dust, water and the like. The collection device may comprise a hood connector, such that a space enclosed by the hood is in fluid connection with a dust collector, and optionally a channel, such as a hose or a pipe 104. A hose 104 leading to the dust collector, such as a vacuum cleaner, may be directly connectable to the hood connector, or to the channel.

The machine 100 may further comprise a handle frame 105 extending from an upper rear portion of the machine frame 101. The handle frame 105 may support a handle 106 for a user to grip and/or steer the machine 100, and optionally a user interface 107.

The user interface 107 may comprise an output device, such as a display, which may be a touch screen, for displaying information. The user interface may further comprise one or more input devices, such as a touch screen, buttons, knobs and/or a keyboard for the user to control the machine 100.

The machine 100 may be supported by wheels, such as by a pair of coaxial wheels 108. The wheels may provide part of the support, with additional, or even most, support provided by the grinding head 1.

The wheels may be freely rotatable, whereby the machine 100 may be propelled entirely by being pushed and/or pulled by the user.

As another option, the wheels may be driven by one or more motors. For example, the wheels may be individually drivable, whereby steering of the machine 100 by e.g. radio control may be enabled.

The machine 100 may comprise a control unit, which contains functionality for controlling the machine 100 and/or feeding back information, such as setting a speed of the rotating discs, and reporting a temperature of grinding discs.

The grinding head 1 as illustrated herein is formed as a planetary type grinding head, i.e. the grinding head casing 5 is rotatable relative to the machine frame 101, and in turn carries two or more grinding disks, each of which being rotatable relative to a grinding head casing 5.

The grinding head hood 2 may define a space in which the grinding casing 5 is rotatable.

The machine 100 comprises a hollow and resilient member 4, arranged in the space, and a pressurized fluid source 50, operatively connected to the hollow member 4 to supply said pressurized fluid 6. The hollow member 4 is resiliently expandable upon supply of said fluid 6. In the following description, the fluid will be described as water, which is what is normally used. However, other types of fluids, including liquids and gases, may be used.

The pressurized fluid source 50 may be provided by a connection to a sufficiently pressurized water supply. In the alternative, the pressurized fluid source 50 may be provided by an onboard water tank which may supply water via a pump. As another alternative, a connection to an external water source may be supplemented by an onboard pump.

The hollow member 4 may be expandable so as to provide a dimensional change. The dimensional change may be in at least one direction. The dimensional change may be of at least 5% in said direction, upon supply of said fluid 6. The change may be of at least 10%, at least 20% or at least 30%.

The change of the hollow member 4 may be decreased upon a decreased pressure of the supplied pressurized fluid. The change may be decreased upon a stop of the supply of the pressurized fluid 6.

The hollow member 4 may be made of an extensible material, such as a polymer or resin. The hollow member 4 may be made of a flexible material, such as rubber.

Figure 2:
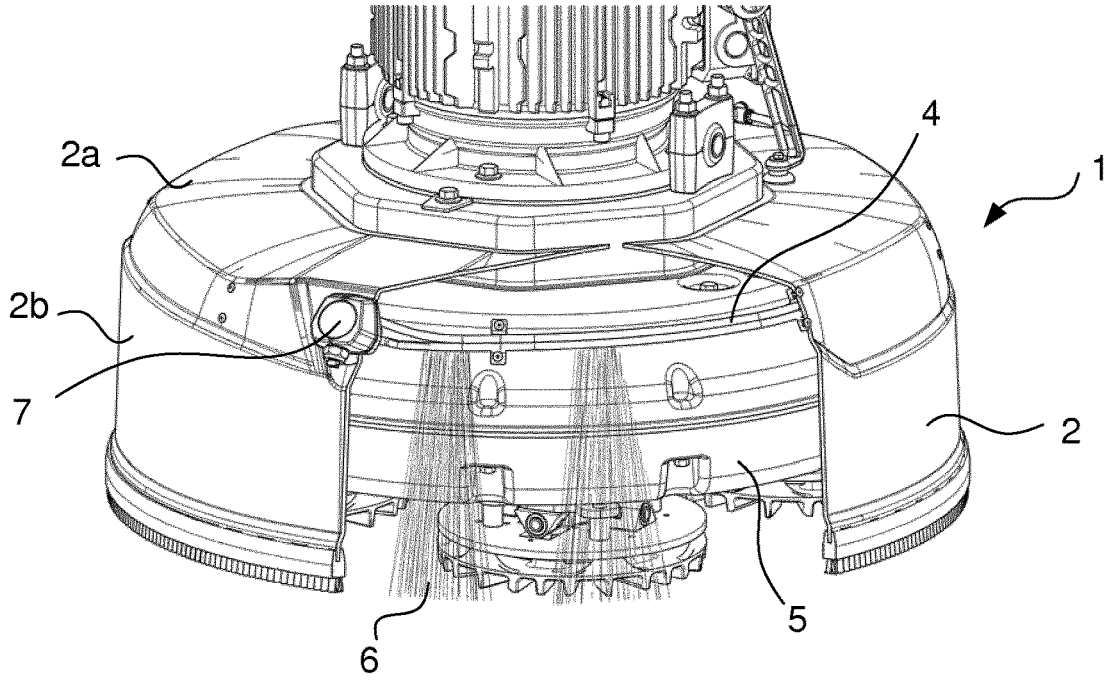
FIG. 2 is a schematic perspective view of a grinding head with a fluid supplied into a space inside of a grinding head hood.
Figure 3:
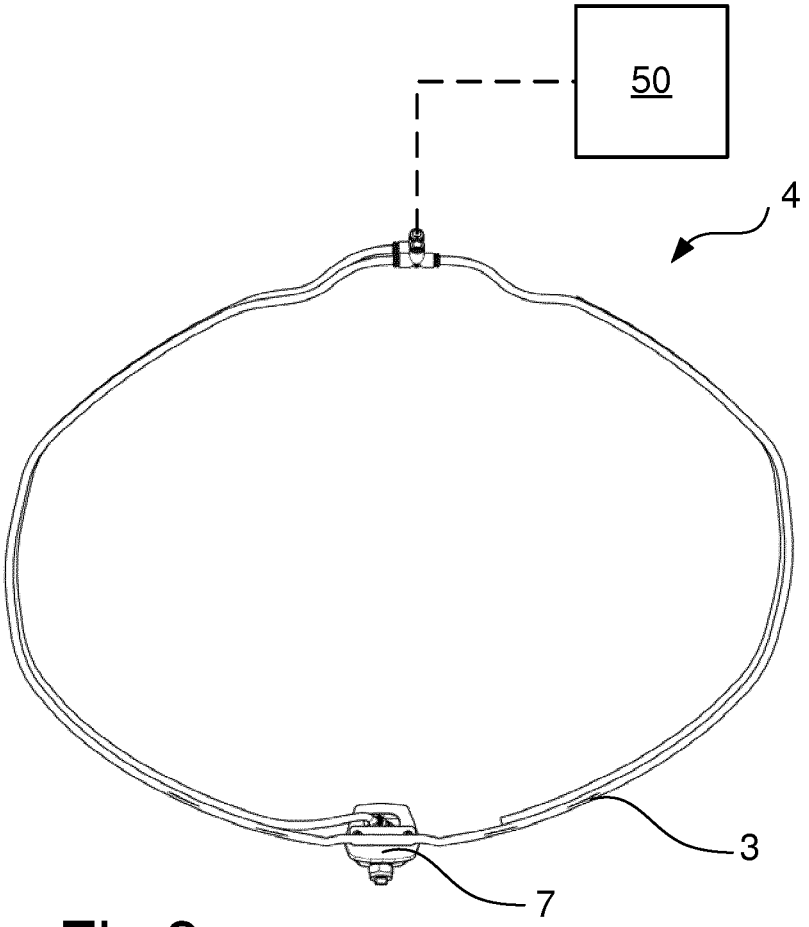
FIG. 3 is a schematic view of a tubular body of a hollow member.

The hollow member 4 may comprise a tubular body, as illustrated in FIGS. 2-3. As shown in FIG. 2, the tubular body may be arranged along an inner surface of the hood 2.

The hollow member 4 may be arranged at a transition portion between an upper horizontal portion 2*a* of the hood 2 and a downwardly extending edge portion 2*b* of the hood 2.

The hollow member 4 may extend at least 40%, preferably at least 50%, at least 60%, at least 70% or at least 80%, of an inner circumference of the hood 2.

A plurality of hollow members 4 may be arranged in the space. Each of them may be individually supplied by a pressurized fluid source 50. Such plurality of hollow members 4 may be spaced apart from each other in the space. They may be arranged along the inner circumference of the hood 2. Alternatively, at least two of the hollow members 4 may be overlapped with each other.

The hollow member 4 may comprise at least one aperture 3 for allowing the fluid 6 to escape.

The aperture 3 may be substantially closed when the hollow member 4 is at a normal ambient pressure. The aperture 3 may be opened when pressurized by supply of said fluid 6 from inside of the hollow member 4.

The aperture 3 may be provided with a lid. The lid may be arranged to block the aperture to isolate the inside of the hollow member 4 from outside. The lid may be pressurized to open by the supply of said fluid 6 from the inside of the hollow member 4. A plurality of apertures 3 may be arranged on the hollow member 4 along a circumferential direction of the hood 2.

The aperture 3 may be a slit. The slit may extend along a longitudinal direction of the hollow member 4. Such a slit may be openable, on supply of the fluid, by less than 2 mm, preferably less than 1 mm or less than 0.5 mm.

The machine 100 may comprise a nozzle 7 operatively connected to the hollow member 4 to receive said fluid 6 and to spray the same.

The nozzle 7 may be arranged outside of the hood 2 such that the nozzle 7 sprays in a direction substantially parallel to a forward moving direction of the machine 100.

Figure 4A:
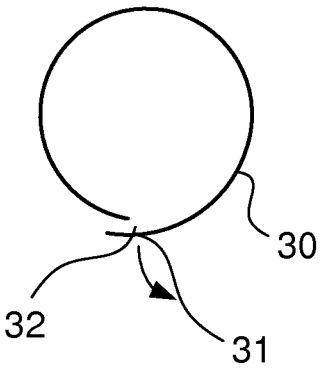
FIGS. 4*a*-4*b* schematically illustrate a hollow member having a closure -.

Referring to FIG. 4*a*, there is disclosed a hollow member 30, which may be formed of a material that is flexible, whereby a portion of the hollow member provides a closure portion 31 of an aperture 32. Hence, the closure portion 31 is integrated with the hollow member 30.

The closure 31 may be biased towards a closed position, i.e. a position wherein the aperture 32 is effectively closed by the closure portion 31.

When supplying a pressurized fluid to the hollow member 30, e.g. as described above, the fluid pressure will cause the closure portion 31 to move and thus to open the aperture, such that fluid may escape.

Accordingly, the movement of the closure portion 31 may cause grinding residues accumulated on or in the vicinity of the hollow member 30 to crack and become more easily released, while fluid may be supplied to e.g. an inside of the hood 2.

Figure 4B:
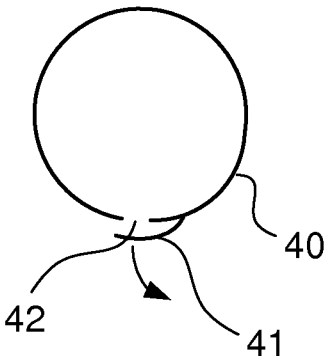

FIG. 4*b* discloses another hollow member 40, which may be formed of an effectively rigid material, such as metal, wherein a closure member 41 is provided as a separate part, which may be attached to the hollow member 40, such that it is biased towards the hollow member and resiliently movable when the hollow member is pressurized, such that fluid is allowed to escape through the aperture 42, analogously with what was disclosed with reference to FIG. 4*a*.

It is recognized that the present device may be arranged on an inside of the hood 2, as described above, so as to supply the fluid to the inside of the hood 2, or to an outside of the hood 2, whereby the fluid is supplied on the outside of the hood 2.

The fluid may be supplied towards the floor surface, towards a wall of the hood 2 or towards the grinding head 1.

The invention claimed is:

1. A floor grinding machine for grinding floor surfaces, the machine comprising:

a machine frame, a grinding head, supported by and being rotatable relative to the machine frame, a grinding head hood, which defines a space in which the grinding head is rotatable, a resilient member arranged inside the space in which the grinding head is rotatable, and a pressurized fluid source, operatively connected to the resilient member to supply said pressurized fluid, whereby the resilient member, or a portion thereof, is resiliently expandable upon supply of said fluid and provides a dimensional change in at least one direction and exhibits a force sufficient to remove grinding residues accumulated on or proximate to the resilient member upon supply of the of the fluid.

2. The floor grinding machine as claimed in claim 1, wherein the resilient member is hollow, the pressurized fluid source is operatively connected to supply the pressurized fluid to an interior of the resilient member and the dimensional change in at least one direction comprises at least 5% upon supply of said fluid.

3. The floor grinding machine as claimed in claim 2, wherein the hollow member comprises a tubular body.

4. The floor grinding machine as claimed in claim 2, wherein the hollow member is arranged on, or forms part of, a wall of the hood.

5. The floor grinding machine as claimed claim 2, wherein the hollow member is arranged along an inner surface of the hood.

6. The floor grinding machine as claimed in claim 2, wherein the hollow member is arranged at a transition portion between an upper horizontal portion of the hood and a downwardly extending edge portion of the hood.

7. The floor grinding machine as claimed claim 2, wherein the hollow member comprises at least one aperture for allowing the fluid to escape.

8. The floor grinding machine as claimed in claim 7, wherein the aperture is substantially closed when the hollow member is at a normal ambient pressure, and opened when pressurized by supply of said fluid from inside of the hollow member.

9. The floor grinding machine as claimed in claim 7, wherein a plurality of apertures are arranged on the hollow member along a circumferential direction of the hood.

10. The floor grinding machine as claimed in claim 7, wherein the aperture is a slit.

11. The floor grinding machine as claimed in claim 10, wherein the slit is openable less than 2 mm in a direction across a longitudinal direction of the slit, on supply of the fluid.

12. The floor grinding machine as claimed in claim 10, wherein the slit extends along a longitudinal direction of the hollow member.

13. The floor grinding machine as claimed in claim 10, wherein the slit extends along a direction which is non-parallel with the longitudinal direction of the hollow member.

14. The floor grinding machine as claimed in claim 1, wherein the resilient member comprises a hollow body and extends along at least 50% of a circumference of the grinding head hood.

15. A floor grinding machine for grinding floor surfaces, the machine comprising:

a machine frame, a grinding head, supported by and being rotatable relative to the machine frame, a grinding head hood, which defines a space in which the grinding head is rotatable, a resilient member arranged inside the space in which the grinding head is rotatable, and a pressurized fluid source, operatively connected to the resilient member to supply said pressurized fluid, whereby the resilient member, or a portion thereof, is resiliently expandable upon supply of said fluid, and wherein the resilient member comprises a closure which is biased towards a position where it closes an aperture, and wherein the resilient member is movable to allow fluid to flow through the aperture on supply of said pressurized fluid.

16. The floor grinding machine as claimed in claim 15, further comprising a hollow member, an interior of which is connected to the pressurized fluid supply and whereby the aperture is arranged in a wall of the hollow member.

17. A method of operating a floor grinding machine for grinding floor surfaces, comprising:

providing a resilient member on a grinding head of the floor grinding machine, and applying a pressurized fluid to the resilient member such that the resilient member expands upon supply of said pressurized fluid and provides a dimensional change in at least one direction and exhibits a force sufficient to remove grinding residues accumulated on or proximate to the resilient member, wherein the resilient member is arranged inside a space in which the grinding head is rotatable.

18. The method as claimed in claim 17, wherein the resilient member is a hollow expandable member, and wherein applying the pressurized fluid comprises causing the resilient member to expand such that the dimensional change in at least one direction comprises at least 5%.

19. The method as claimed in claim 17, further comprising feeding the fluid through at least one aperture of the resilient member, such that the fluid is allowed to exit from the resilient member.

20. The method as claimed in claim 17, wherein the resilient member comprises a closure of a hollow member, and wherein the pressurized fluid is applied to an interior of the hollow member, such that the closure is moved away from an aperture of the hollow member, whereby the fluid is allowed to exit from the hollow member.

* * * * *